US005273448A

United States Patent [19]

Myer et al.

[11] Patent Number: 5,273,448

[45] Date of Patent: Dec. 28, 1993

[54] SHORTING SPRING CONCEPT

[75] Inventors: John M. Myer, Millersville, Pa.; Gary R. Marpoe, Jr., Kernersville, N.C.

[73] Assignee: The Whitaker Corporation, Wilmington, Del.

[21] Appl. No.: 33,669

[22] Filed: Mar. 16, 1993

[51] Int. Cl.[5] ..... H01R 13/00

[52] U.S. Cl. ..... 439/188

[58] Field of Search ..... 439/180–188

[56] References Cited

U.S. PATENT DOCUMENTS

| | | | |
|---|---|---|---|
| 3,627,929 | 12/1971 | Vlijmen | 179/96 |
| 4,070,557 | 1/1978 | Ostapovitch | 439/188 |
| 4,358,135 | 11/1982 | Satosi et al. | 439/188 |
| 4,438,303 | 3/1984 | Astier | 200/51.1 |
| 4,552,423 | 11/1985 | Swengel | 339/19 |
| 4,786,258 | 11/1988 | Shaffer et al. | 439/188 |
| 4,832,614 | 5/1989 | Jenkins | 439/188 |
| 4,952,170 | 8/1990 | Pritulsky | 439/509 |
| 5,030,123 | 7/1991 | Silver | 439/188 |
| 5,071,362 | 12/1992 | Martens et al. | 439/188 |
| 5,174,776 | 12/1992 | Ohtaka et al. | 439/188 |

*Primary Examiner*—Joseph H. McGlynn

*Attorney, Agent, or Firm*—Bruce J. Wolstoncroft

[57] ABSTRACT

A shorting contact for an electrical system has a first circuit body having at least one shorting spring and a second circuit body having at least one shorting spring. The circuit bodies are mounted adjacent and opposite one another internally in a plug housing so that the shorting springs may contact one another to form an electrical connection. The respective circuit bodies are each in electrical connection with respective socket contacts. A header to be mated to the plug housing has a rib formed thereon. When the header is mated to the plug housing the rib extends through a slot in a spacer between the header and the plug housing and the rib contacts the shorting springs and separates the shorting springs to open the electrical circuit.

12 Claims, 8 Drawing Sheets

SHORTING SPRING CONCEPT

The present invention relates to shorting contacts for an electrical system, and more particularly, to shorting contacts in a plug housing which mates with a header.

BACKGROUND OF THE INVENTION

In an electrical system where a header is mated with a plug housing, there is frequently a need to provide an electrical short between components within the plug housing. An example of this situation is in a circuit related to an air bag in an automobile or other vehicle. During assembly of the circuitry of the air bag or after assembly, when maintenance or repair work is being conducted on the vehicle in the vicinity of the air bag, it is important that the air bag not be activated accidentally. Accidental activation of the air bag may cause injury to workers and will incur unnecessary expenses. Thus, it is highly desirable to have a means to inactivate or disarm the triggering circuitry such as for the air bag.

It is known to have a shorting contact on the plug housing to disarm the triggering circuitry and to provide a prong to open the shorting contacts to arm the triggering circuitry. However, the shorting contacts are external to the plug housing, usually on the spacer between the header and the plug housing, and are easily damaged or may inadvertently be opened due to the ease of access to the shorting contacts. Also, the prong to open the shorting contacts is usually a prong extending toward the shorting contacts which is supported at a single juncture and is subject to breakage at the juncture. Furthermore, the shorting contacts are not in the same circuit as socket contacts in the plug housing but usually the shorting contacts are placed on a component of the electrical system separate from the socket contacts. This arrangement is not compact and requires space be provided in the plug housing and/or the header to permit inclusion of the shorting contacts.

SUMMARY OF THE INVENTION

The present invention provides a shorting contact disposed internally in a plug housing and in electrical connection with the socket contact within the plug housing. The shorting contact provides positive control over the arming/disarming of the electrical circuit, is space efficient and is readily adaptable to low-cost manufacture.

In accordance with the teachings of the present invention, there is herein disclosed a shorting contact in a plug housing for an electrical system. The plug housing has a plurality of spaced-apart openings formed therein. A socket contact is disposed in each opening. The plug housing has an end mating with a header. The shorting contact has a first circuit body having at least one shorting spring formed thereon and a second circuit body having at least one shorting spring formed thereon. The first and second circuit bodies are mounted adjacent to and opposite one another internally of the plug housing. The at least one shorting spring on the first circuit body may contact the at least one shorting spring on the second circuit body to form an electrical connection therebetween. The first circuit body and the second circuit body each are in electrical connection with the respective socket contacts. A extending rib is formed in the header. When the header is mated with the plug housing, the rib is slidingly received between the at least one shorting spring on the first circuit body and the at least one shorting spring on the second circuit body. In this manner, the rib separates the respective shorting spring and opens the electrical connection therebetween.

Each shorting spring has a leg having a respective first end. The respective first ends of each leg extend inwardly at an angle from the end of the plug housing. A foot is formed on each respective first end of each leg. The respective feet are substantially parallel to one another and contact one another to form the electrical connection.

The rib is received between the respective legs on each shorting spring and separates the respective legs without contacting the respective feet on the shorting springs. A spacer is disposed between the plug housing and the header and the spacer has a slot formed therein. When the header is mated to the plug housing, the rib on the header slides through the slot and is received between the respective shorting springs.

These and other objects of the present invention will become apparent from a reading of the following specification, taken in conjunction with the enclosed drawings.

DETAILED DESCRIPTION OF THE PREFERRED EMBODIMENTS

Figure 1:
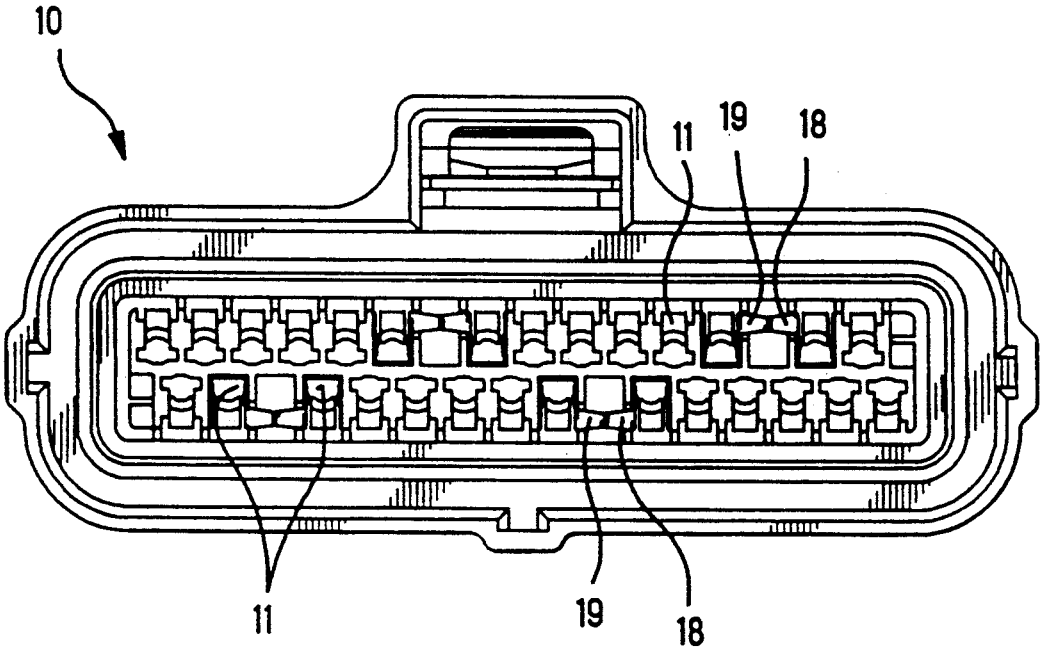
FIG. 1 is a front elevation plan view of the plug housing showing the shorting contacts.
Figure 2:
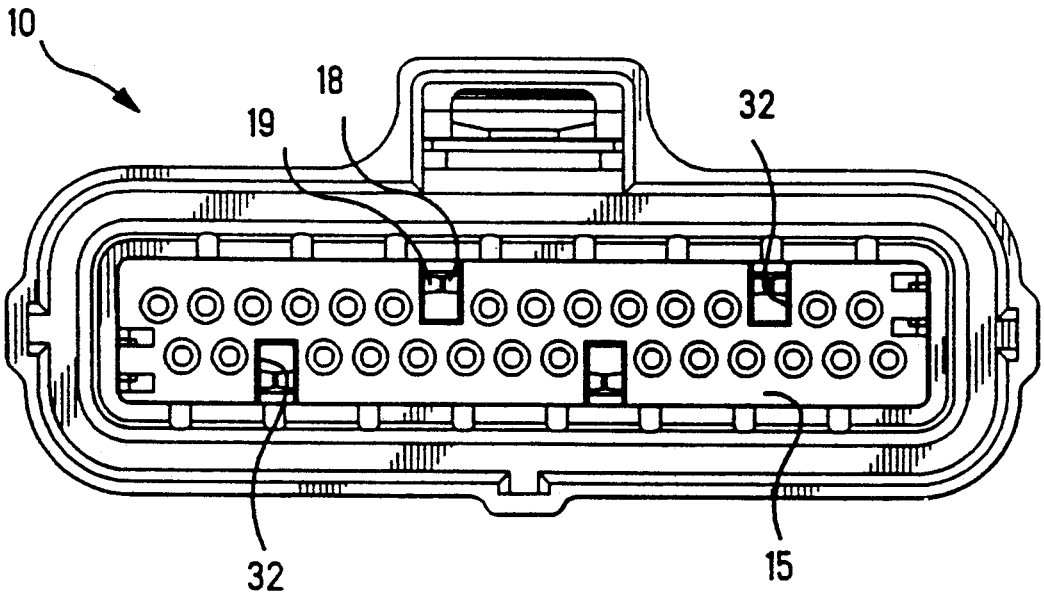
FIG. 2 is a front elevation plan view of the plug housing showing the spacer with slots disposed on the plug housing.
Figure 3:
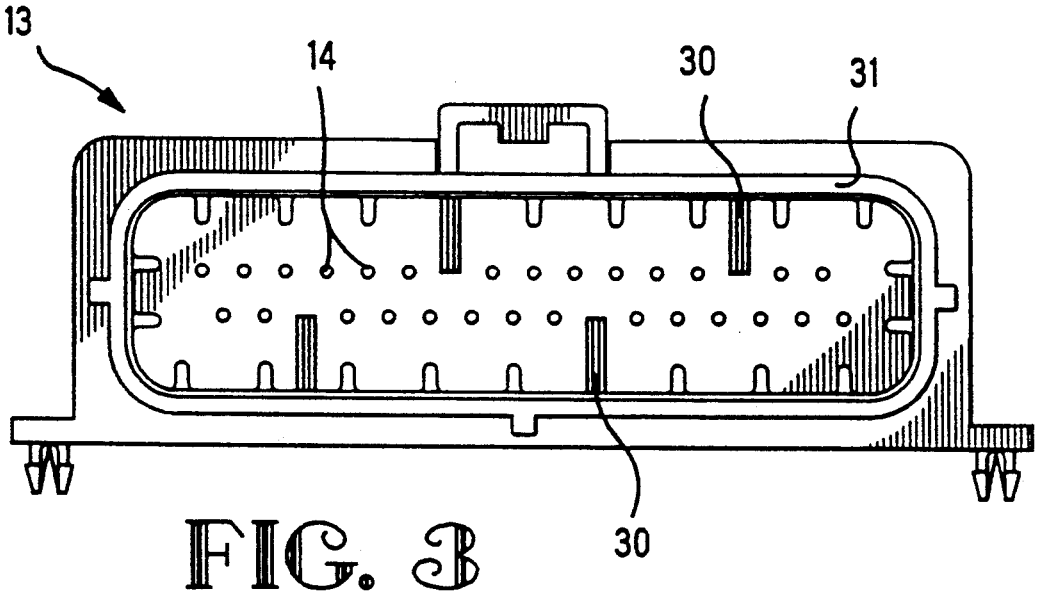
FIG. 3 is a front elevation plan view of the header showing the ribs formed on the header.
Figure 4:
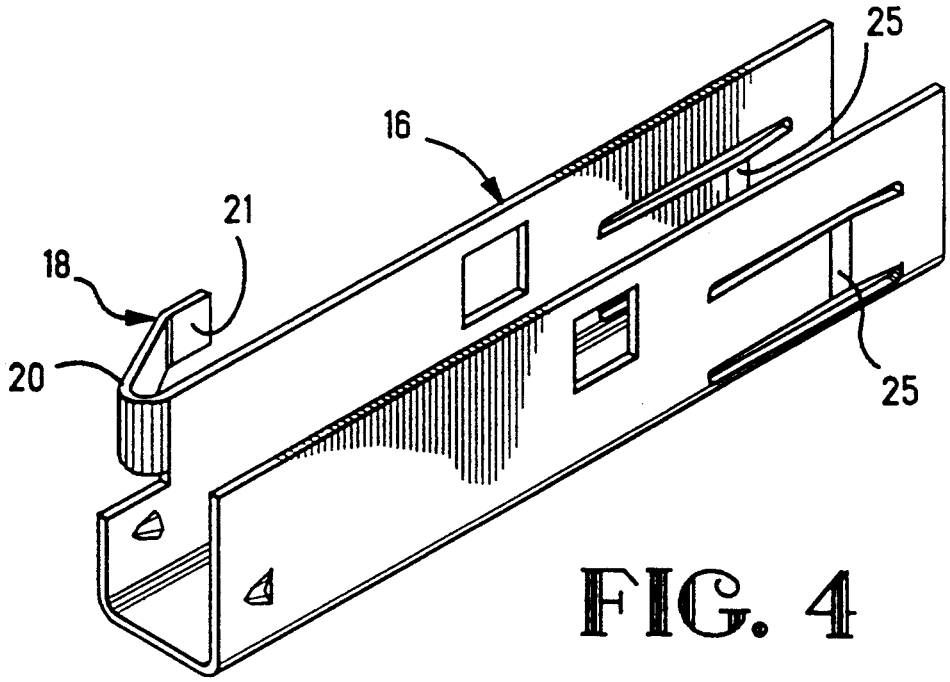
FIG. 4 is a perspective view of the first circuit body having a left facing shorting spring.

With reference to FIGS. 1–3, the plug housing 10 has a plurality of spaced-apart openings 11 formed therein. A socket contact 12 is disposed in each opening. A header 13 is provided with a plurality of spaced-apart leads 14 extending therethrough. The header 13 is mated with the plug housing 10 and the leads 14 are received in the respective openings 11. Preferably, a spacer 15 having openings therein, corresponding to and aligned with, the leads 14 and the openings 11, is disposed between the header 13 and the plug housing 10.

The header 13 and plug housing 10 are components of an overall electrical system such as in a vehicle or electronically controlled device where a harness of wires are connected. In these systems, it is frequently desirable to incorporate a shorting circuit to permit arming or disarming of an electrical device. The device may be an air bag in a vehicle and there are situations of assembly and/or repair when electrical activation of the device is not wanted.

Figure 5:
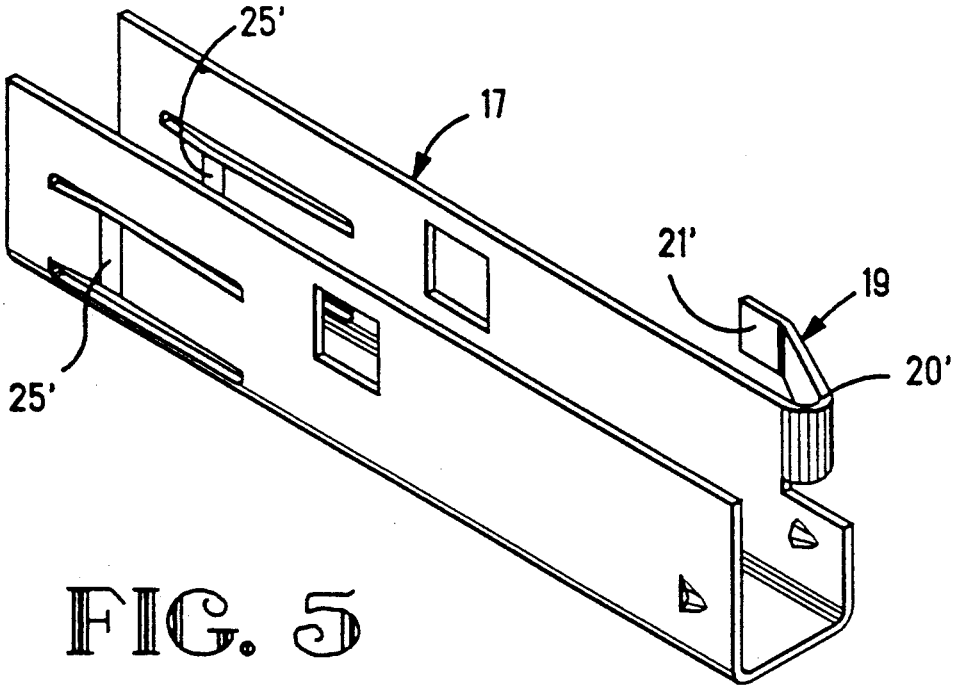
FIG. 5 is a perspective view of the second circuit body having a right facing shorting spring.
Figure 6:
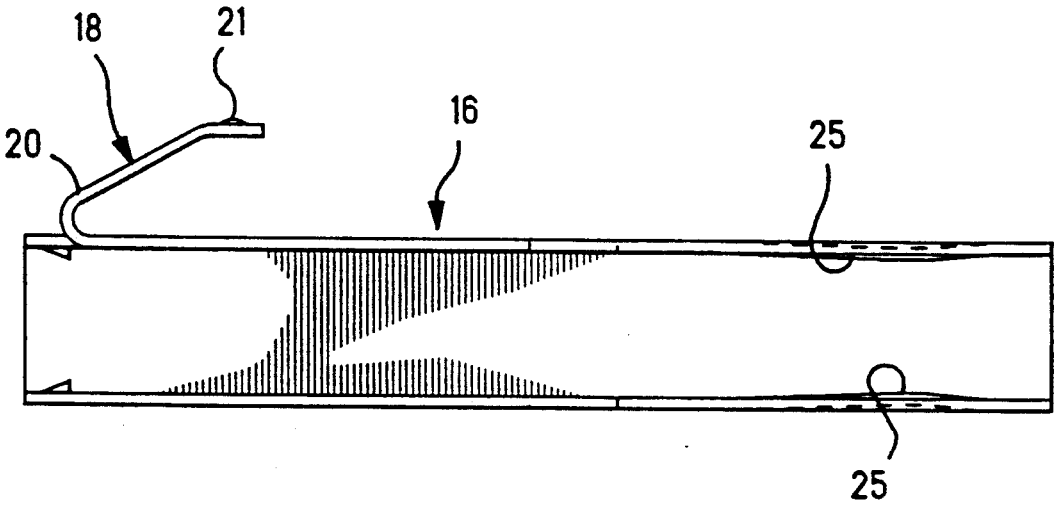
FIG. 6 is a top plan view of FIG. 4.
Figure 7:
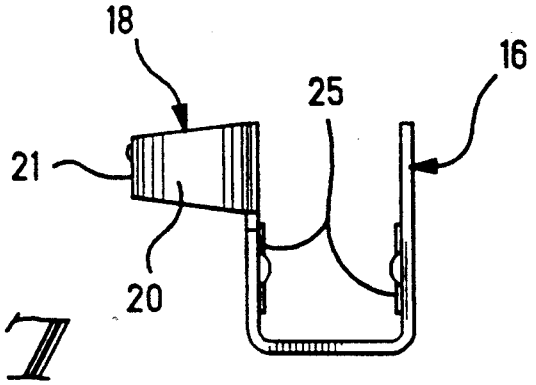
FIG. 7 is an end view of FIG. 4.
Figure 8:
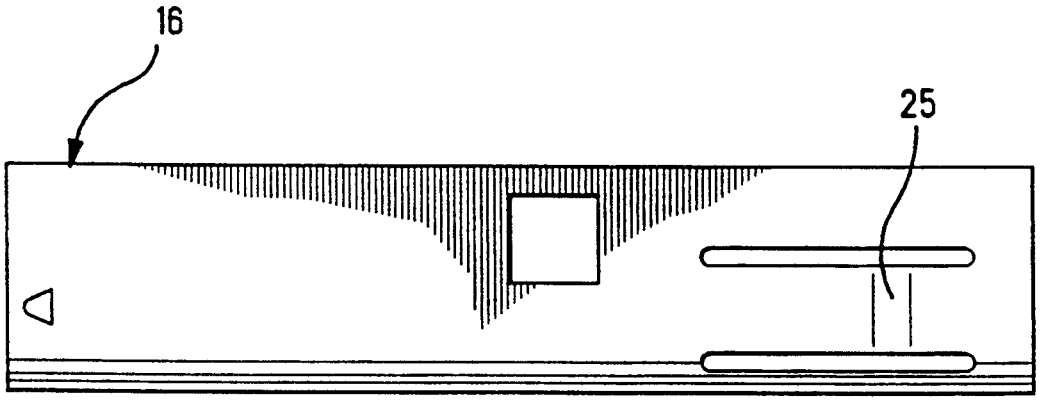
FIG. 8 is a side view of FIG. 4.

The present invention is directed to a shorting contact which has a first circuit body 16 (FIGS. 4, 6–8) and a second circuit body 17 (FIG. 5). The first circuit body 16 has at least one left facing shorting spring 18 formed thereon and the second circuit body 17 has at least one right facing shorting spring 19 formed thereon. The first circuit body 16 and the second circuit body 17 are mirror images of each other. Each shorting spring 18, 19 has a respective leg 20, 20' extending outwardly at an angle to the respective circuit body 16, 17. Each leg 20, 20' has a first end distal from the respective circuit body 16, 17 and a foot 21, 21' is formed on the first ends of each leg 20, 20'.

Figure 9:
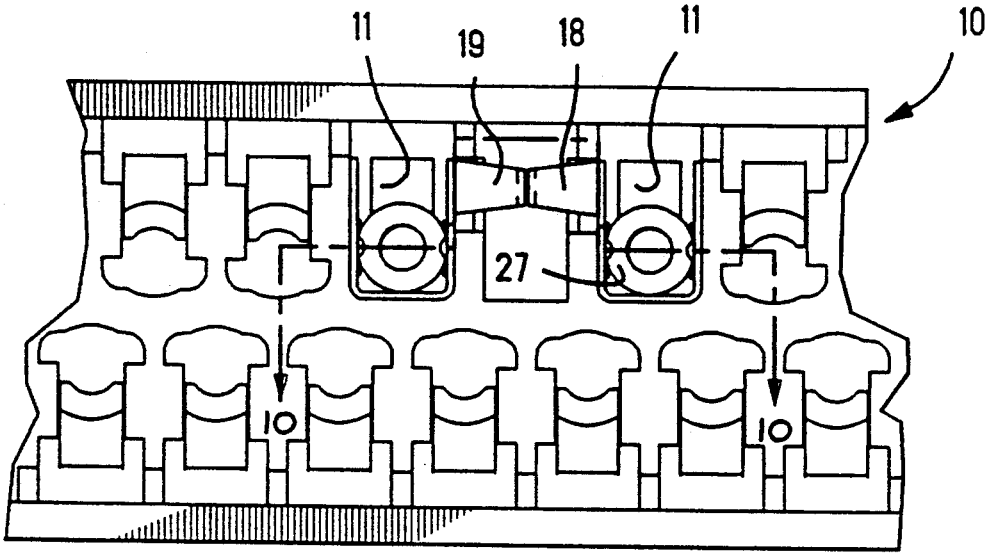
FIG. 9 i s an enlarged view of a portion of FIG. i showing a pair of socket contacts and the shorting contacts therebetween.
Figure 10:
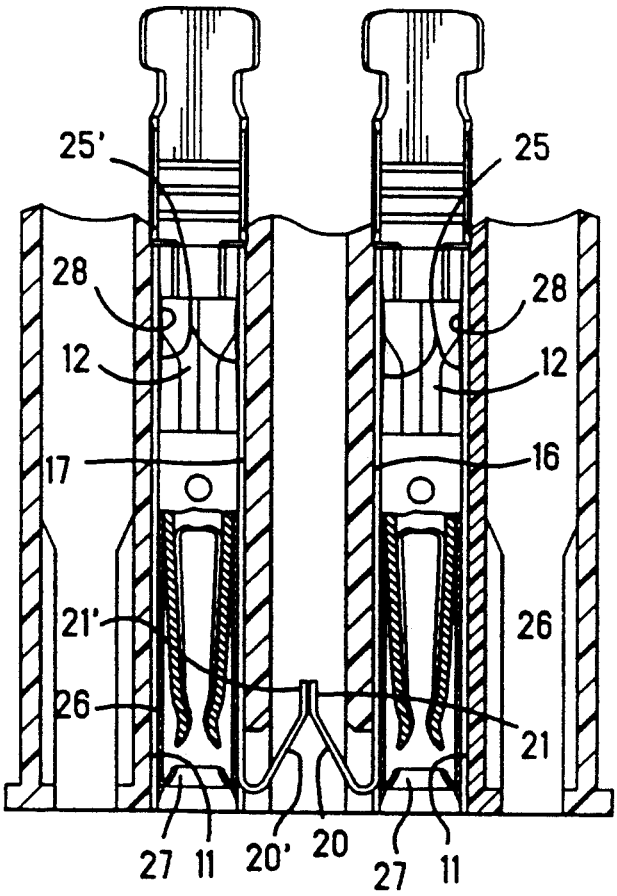
FIG. 10 is a cross-sectional view of FIG. 9 taken across the lines 10—10 of FIG. 9.
Figure 11:
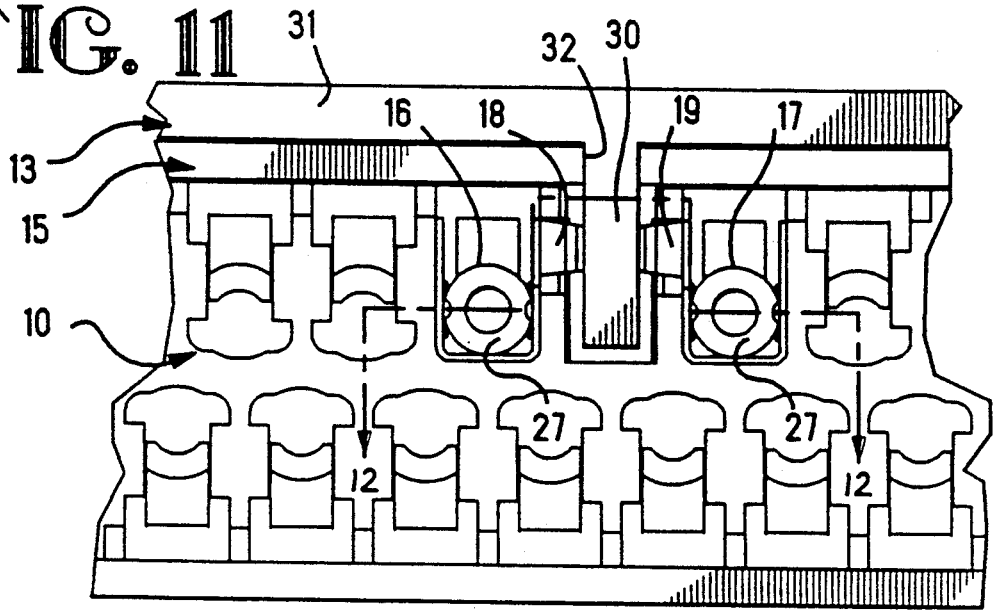
FIG. 11 is a partial front elevation view showing the header mated with the plug housing and the rib on the header separating the left facing contact spring from the right facing contact spring.

The circuit bodies 16, 17 are disposed in the housing 10 such that the respective bodies 16, 17 extend inwardly in the respective adjacent openings 11 with the spring 18, 19 disposed near the end of the plug housing 10 which mates with the header 13. In this manner, the first circuit body 16 is adjacent to and opposite the second circuit body 1 7. The legs 20, 20' are disposed in a cavity formed in the plug housing between a pair of adjacent openings 11. The leg 20 on the left facing spring 18 and the leg 20' on the right facing spring 19 are angled toward one another such that the respective feet 21, 21' are substantially parallel to one another and touch to form an electrical connection therebetween. It is preferred that the feet 21, 21' are gold or tin plated to provide an efficient electrical contact (FIGS. 9, 10).

Each circuit body 16, 17 further has beam portions 25, 25' respectively formed thereon on a section of the respective circuit body 16, 17 distal from the spring. Preferably, the beam portions 25, 25' are formed on both sides of the respective circuit bodies 16, 17 diametrically opposed to one another. This structure provides a stable shorting connection to the socket contacts because of contact on both sides with equal and opposite forces which centers the socket contact 12 and still allows free float of the socket contacts 12 in the plug housing 10. When disposed in the openings 11 in the plug housing 10, the circuit bodies 16, 17 are adjacent to the walls of the openings 11.

Thus, the entire first circuit body 16 and second circuit body 17 are in the plug housing 1? and none of the shorting contacts can be damaged or inadvertently opened by forces external to the plug housing 10.

The socket contacts 12 are disposed in the openings 11 adjacent to the circuit bodies 16, 17 so that the circuit bodies 16, 17 are between the socket contacts and the walls of the openings 11. The socket contacts 12 are connected to a copper sleeve 26 formed on the end of the socket contact Which is disposed proximal to the end of the plug housing 10 which mates with the header 13. The copper sleeve 26 preferably is formed as a drawn cylinder having no seams and has a funnel-shaped end 27 which opens toward the mating header 13. In this manner, leads 14 from the header 13 are directed into the respective socket contact 12 to facilitate mating of the plug housing 10 with the header 13. The second end of the copper sleeve 26 opposite to the funnel-shaped end is clinched to secure the copper sleeve 26 to the socket contacts 12. Due to the oxidation of copper which interferes with satisfactory electrical connections, it is preferred that the circuit bodies 16, 17, be electrically connected directly to the socket contacts 12 and not to the copper sleeve 26. A shoulder 28 is formed on the socket contact 12 at a point inward of the second end of the copper sleeve 26. Preferably the shoulder 28 in each socket contact 12 is plated with tin or gold and is in electrical contact with the beam portions 25, 25' of the respective first circuit body 16 and second circuit body 17.

The beam portions 25, 25' have a length which is greater than the distance between the second end of the copper sleeve 26 and the end of the shoulder 28 which is closest to the second end of the copper sleeve 26. Thus, during assembly of the plug housing 10, employees do not obtain a "false lock-up" feeling when inserting the socket contact 12 into the opening 11 in which the circuit body 16, 17 is already assembled. The employees must insert the socket contact 12 until the socket contact 12 "locks" in place and correct placement requires that the beam portions 25, 25' have the greater length as noted.

Figure 12:
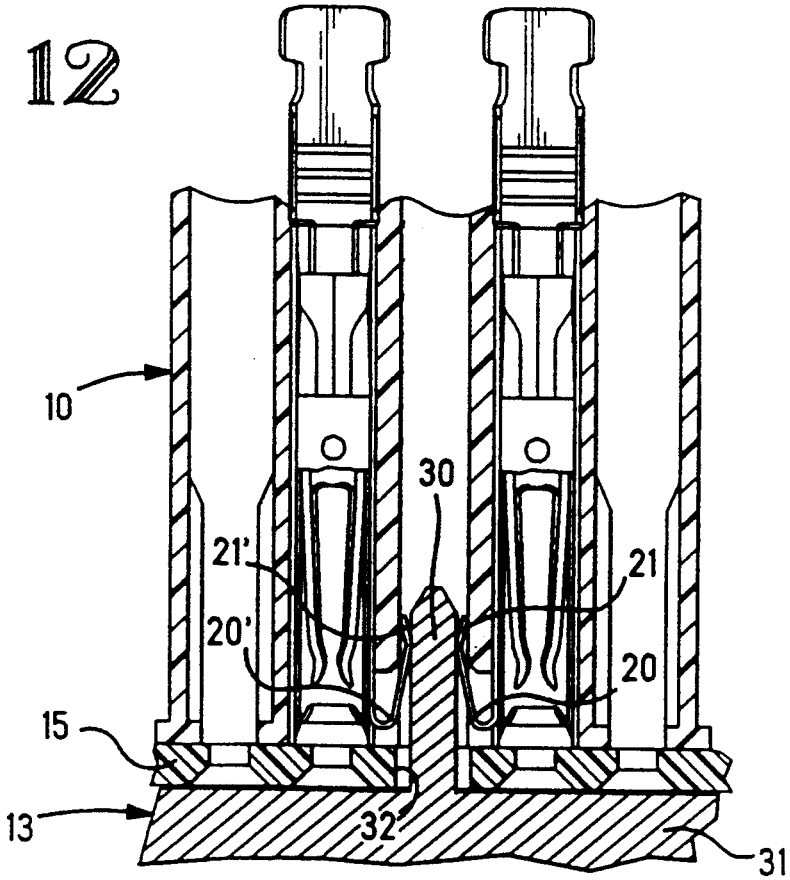
FIG. 12 is a cross-sectional view showing the rib on the header separating the left facing contact spring from the right facing contact spring.
Figure 13A:
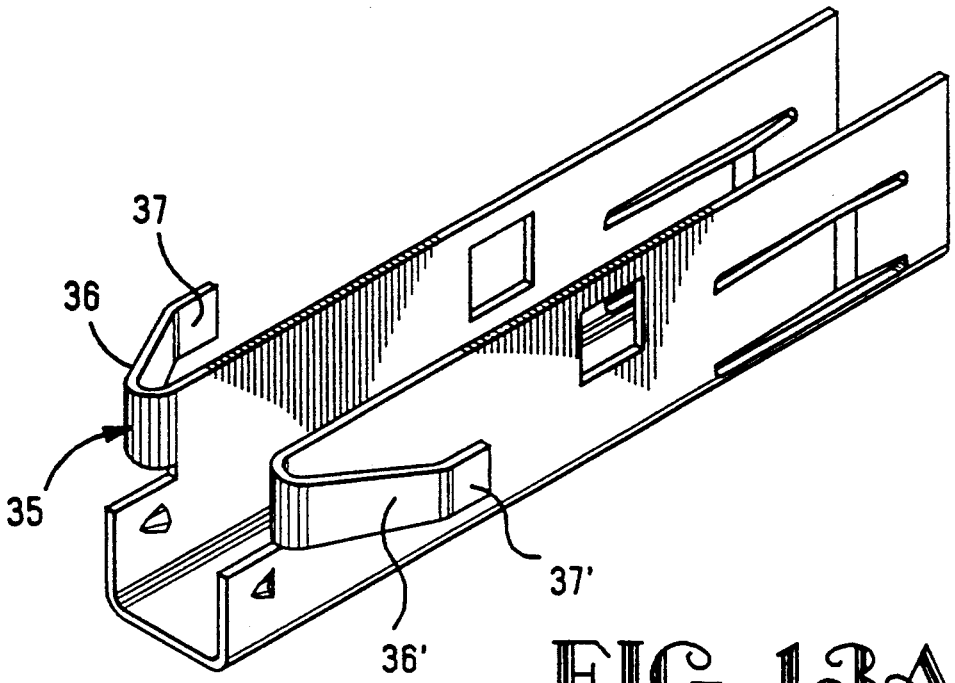
FIGS. 13A–13C are perspective views of alternate embodiments of the circuit body having two shorting springs.
Figure 13B:
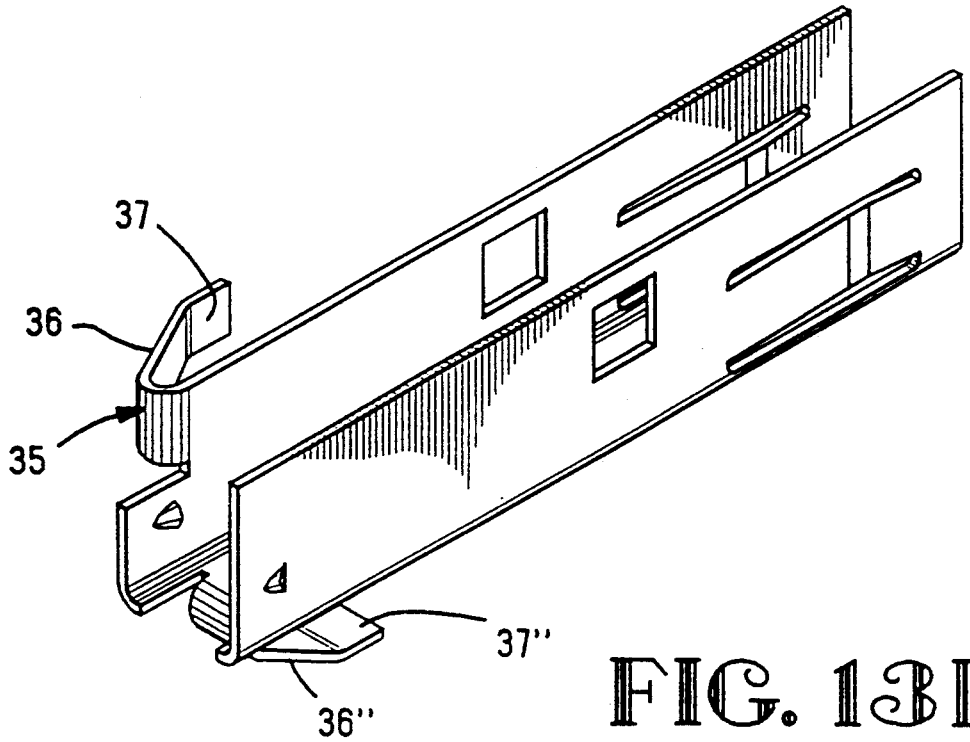
Figure 13C:
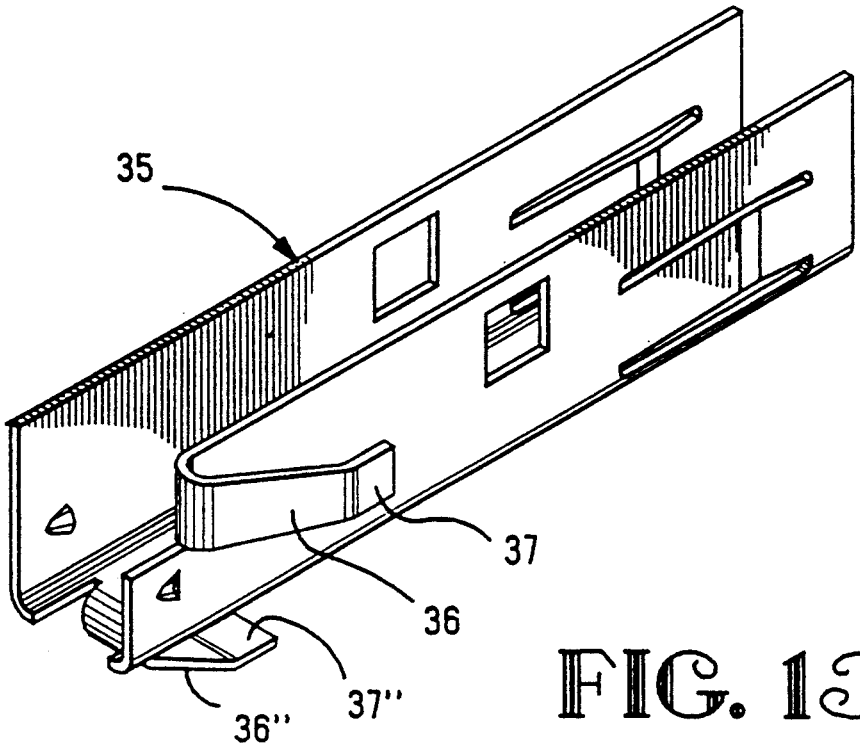
Figure 13D:
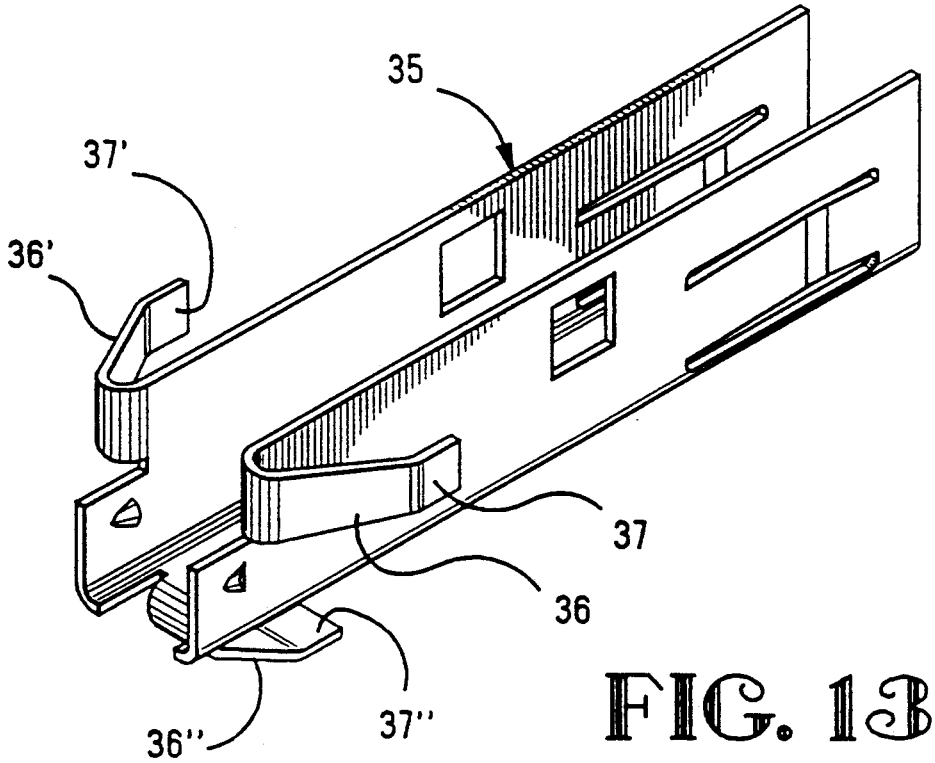
FIG. 13D is a perspective view of an alternate embodiment of the circuit body having three shorting springs.

In order to open the shorted circuit when the header 13 is mated to the plug housing 10, an extending rib 30 is formed perpendicularly on the outer edge of the shroud 31 on the header 13. The rib 30 is oriented lengthwise toward the opposite wall of the header 13 and has a relatively short height oriented toward the plug housing 10 when mated thereto. Thus, the rib is minimally subject to flexing type forces. A slot 32 is formed in the spacer 15 so that when the plug assembly 10 is mated to the header 13, the rib 30 slides through the slot 32 and is slidingly received between the left facing shorting spring 18 and the right facing shorting spring 19. The rib 30 contacts the respective legs 20, 20' on the respective shorting springs 18, 19 and separates the legs 20, 20' without contacting the feet 21, 21' (FIG. 12). Thus, the surfaces of the feet 21, 21' are isolated and not damaged in any way by the rib 30 and debris or contamination is not introduced between the feet 21, 21'.

In an alternate embodiment, the circuit body 35 may have two or three shorting springs 36, 36 , 36" formed thereon (FIGS. 13A–13D). The two shorting springs 36, 36' may be diametrically opposed to one another being formed on opposite sides of the U-shaped circuit body 35. Alternately, the two shorting springs 36, 36' may be adjacent to one another, one shorting spring 36 being formed on a side of the U-shaped circuit body 35 and the other shorting spring 36" being formed on the base of the U-shaped circuit body 35. The shorting spring 36 on the side of the circuit body 35 may be right facing or left facing with respect to the spring 36" on the base of the circuit body 35. The embodiment having three shorting springs 36, 36', 36" has a shorting spring formed on the base and on both sides of the U-shaped circuit body 35. Each shorting spring 36, 36', 36" formed on the distal end of the respective leg as previously described for the circuit body 16, 17, has at least one foot 37, 37', 37" formed thereon.

In this manner, by disposition of the circuit body 35 in the plug housing 10, any desired combination of socket contact 12 (and not only adjacent socket contact 12)

may be shorted. Thus, an entire row of socket contact 12 may be shorted or a short may be possible between socket contact 12 on opposite sides of the plug housing. The alternate embodiment also has ribs 30 formed on the header 13 at locations as desired to be sliding received between any pair of selected shorting springs 36, 36', 36" when the header 13 is mated with the plug housing 10.

The shorting contact of the present invention provides shorting springs which are totally protected inside the plug housing. The shorting contacts may be located adjacent to the socket contacts thereby reducing the overall size of the interface between the plug housing and the header. The shorting springs and circuit bodies can be stamped in pairs and partially inserted simultaneously. As a result, production costs can be reduced. Shorting is accomplished at a plated shoulder on a socket contact and not on a bare copper surface. The rib to separate the shorting contacts is rugged and not subject to breakage.

Obviously, many modifications may be made without departing from the basic spirit of the present invention. Accordingly, it will be appreciated by those skilled in the art that within the scope of the appended claims, the invention may be practiced other than has been specifically described herein.

We claim:

1. A shorting contact in a plug housing for an electrical system, the plug housing having a plurality of spaced-apart openings formed therein, a socket contact being disposed in each opening, the plug housing having an end mating with a header, the shorting contact comprising:

a first circuit body having at least one shorting spring formed thereon;

a second circuit body having at least one shorting spring formed thereon;

the first and second circuit bodies being mounted adjacent to and opposite one another internally of the plug housing, wherein the at least one shorting spring on the first circuit body may contact the at least one shorting spring on the second circuit body to form an electrical connection therebetween;

the first circuit body and second circuit body each being in electrical connection with the respective socket contacts;

the header having an extending rib formed thereon whereby when the header is mated with the plug housing, the rib is slidingly received between the at least one shorting spring on the first circuit body and the at least one shorting spring on the second circuit body, thereby separating said shorting springs and opening the electrical connection therebetween.

2. The shorting contact of claim 1, further comprising a spacer disposed between the plug housing and the header, the spacer having a slot formed therein, wherein, when the header is mated with the plug housing, the rib on the header slides through the slot and is received between the respective shorting springs.

3. The shorting contact of claim 1, further comprising a third circuit body having at least one shorting spring formed thereon, the third circuit body being mounted adjacent to the first circuit body, the first circuit body having at least two shorting springs formed thereon, such that the shorting springs on the first circuit body may contact the respective shorting springs on the second and third circuit bodies to form an electrical connection therebetween, the header having at least two extending ribs formed thereon such that when the header is mated with the plug housing, the respective ribs are slidingly received between the shorting springs on first and second circuit bodies and between the shorting springs on the first and third circuit bodies thereby separating said shorting springs and opening the electrical connection therebetween.

4. The shorting contact of claim 1, wherein each shorting spring has a leg having a respective first end, the respective first ends of each leg extending inwardly at an angle from the end of the plug housing, a foot being formed on each respective first end of each leg, wherein the respective feet are substantially parallel to one another and contacting one another to form the electrical connection.

5. The shorting circuit of claim 4, wherein when the rib is received between the shorting springs, the rib contacts the respective legs on each shorting spring and separates the respective legs without contacting the respective feet on the shorting springs thereby protecting said feet from damage by the rib and preventing debris from being introduced between said feet.

6. The shorting contact of claim 4, wherein each foot is plated for efficient electrical contact.

7. The shorting contact of claim 1, wherein the first circuit body and the second circuit body each extend inwardly from the end of the plug housing, each circuit body having a beam portion formed thereon distal from the end of the plug housing, the respective beam portions of each circuit body making electrical connection with the respective socket contacts, wherein the shorting contact is in the same electrical circuit as the socket contact and a saving of space is effected.

8. The shorting contact of claim 7, further comprising each circuit body having two beam portions, the two beam portions being diametrically opposed to one another, wherein the socket contact is centered in the respective opening in the plug housing.

9. The shorting of claim 7, wherein each socket contact has a shoulder formed thereon, the respective shoulders being in electrical connection with the respective beam portions of each circuit body.

10. The shorting contact of claim 9, wherein the respective shoulders are tin plated for electrical connection with the respective beam portions of each circuit body.

11. A shorting contact in a plug housing for an arming and disarming circuit for a vehicle air bad, the plug housing having an end mating with a header, the shorting contact comprising:

a plurality of spaced-apart openings formed in the plug housing;

a cavity formed in the plug housing between two adjacent openings;

a first circuit body disposed in one of said openings, the first circuit body having a first end projecting into said opening and a second end terminating at the end of the plug housing;

a resilient leg formed on the second end of the first circuit body, the resilient leg having an end extending angularly into the cavity in the plug housing, a foot formed on the end of the resilient leg;

a second circuit body disposed in an opening adjacent to the one opening, the second circuit body being a mirror image of the first circuit body wherein the foot on the first circuit body is disposed in the cavity substantially parallel to and contacting the foot on the second circuit body to form an electrical connection;

a socket contact in each opening;

means for making electrical contact between the respective first ends of the circuit bodies and the socket contacts in each openings;

a rib formed on the header, wherein when the header is mated with the plug housing, the rib contacts the resilient legs on the first circuit body and on the second circuit body and separates the respective legs without contacting the respective feet so that the shorting contacts are opened.

12. In a shorting contact in a plug housing for an arming and disarming circuit for a vehicle air bag, the improvement comprising:

the plug housing having a pair of adjacent shorting contacts formed therein; the shorting contacts touching to make an electrical connection, each shorting contact further being in electrical contact with respective socket contacts within the plug housing;

a header to be mated with the plug housing;

a rib formed on the header wherein when the header mates with the plug housing, the rib is slidingly received between the adjacent shorting contacts and separates the shorting contacts and opens the electrical connection therebetween.

* * * * *